US007144231B2

(12) United States Patent
Davis

(10) Patent No.: US 7,144,231 B2
(45) Date of Patent: Dec. 5, 2006

(54) PERISTALTIC PUMP WITH GANGED TUBES

(75) Inventor: Jeremy A Davis, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 373 days.

(21) Appl. No.: 10/626,361

(22) Filed: Jul. 23, 2003

(65) Prior Publication Data

US 2005/0019186 A1 Jan. 27, 2005

(51) Int. Cl.
*F04B 43/08* (2006.01)
*F04B 43/12* (2006.01)
*F04B 45/06* (2006.01)

(52) U.S. Cl. ..... 417/477.12; 417/53; 417/474

(58) Field of Classification Search ..... 417/474–476, 417/477.1, 477.12; 347/85; 101/364–367, 101/350.6, 350.1
See application file for complete search history.

(56) References Cited

U.S. PATENT DOCUMENTS

| | | | | |
|---|---|---|---|---|
| 2,865,303 A | | 12/1958 | Ferrari, Jr. et al. | |
| 3,079,868 A | | 3/1963 | Ormsby | |
| 3,116,697 A | * | 1/1964 | Bilichniansky | 417/475 |
| 3,429,273 A | | 2/1969 | Jones | |
| 3,723,030 A | * | 3/1973 | Gelfand | 417/475 |
| 3,740,173 A | * | 6/1973 | Natelson | 417/475 |
| 3,832,096 A | * | 8/1974 | Gelfand | 417/475 |
| 4,289,459 A | * | 9/1981 | Neeley et al. | 417/475 |
| 4,294,802 A | * | 10/1981 | Johansson | 422/103 |
| 4,522,570 A | | 6/1985 | Schartz | |
| 4,604,038 A | * | 8/1986 | Belew | 417/475 |
| 4,997,347 A | * | 3/1991 | Roos | 417/475 |
| 5,096,393 A | * | 3/1992 | Van Steenderen et al. | 417/475 |
| 6,033,060 A | * | 3/2000 | Minami | 347/85 |
| 6,041,709 A | * | 3/2000 | Wells et al. | 101/366 |
| 6,217,164 B1 | * | 4/2001 | Hino | 347/85 |
| 2004/0022656 A1 | * | 2/2004 | Anderson | 417/477.1 |
| 2005/0019185 A1 | * | 1/2005 | Otis | 417/475 |

* cited by examiner

*Primary Examiner*—William H. Rodriguez

(57) ABSTRACT

A pump having a rotary portion which compels the movement of a fluid by peristaltic compression of resilient tubing containing the fluid includes a tube component having a plurality of adjacent resilient tubes, with a web interconnecting the adjacent resilient tubes. The web may be offset from the centerline of the tubes so as not to degrade the compressibility of the tubes.

5 Claims, 2 Drawing Sheets

PERISTALTIC PUMP WITH GANGED TUBES

FIELD OF THE INVENTION

The invention relates generally to resilient tubes used in peristaltic pumps.

BACKGROUND OF THE INVENTION

Peristaltic pumps are used in a variety of applications in which it is desirable to convey fluid in accurately controllable quantities. Peristaltic pumps typically include a rotary portion that compels the movement of a fluid by peristaltic compression of resilient tubing containing the fluid.

Imaging systems using inkjet printing have become widely known, and are often implemented using thermal inkjet technology. Such technology forms characters and images on a medium, such as paper, by expelling droplets of ink in a controlled fashion so that the droplets land on the medium. The printer, itself, can be conceptualized as a mechanism for moving and placing the medium in a position such that the ink droplets can be placed on the medium, a printing cartridge which controls the flow of ink and expels droplets of ink to the medium, and appropriate hardware and software to position the medium and expel droplets so that a desired graphic is formed on the medium. A conventional print cartridge for an inkjet type printer comprises an ink containment device and an ink-expelling apparatus, commonly known as a printhead, which heats and expels ink droplets in a controlled fashion.

In some inkjet type printers, a peristaltic pump head is used to drive multiple, resilient tubes to convey ink between the containment device and the printhead. Unless the resilient tubes are perfectly aligned parallel to the occlusion of the pump roller, the tubes have a tendency to migrate to a point of lower force during pump operation. Tube migration can result in the tubes bunching together, which can increase the force required to collapse the tubes. The forces applied by bunched tubes can also change the natural restoring force of the tubes. Tube migration can also result in individual tubes moving to one side of the pump or the other, which can also undesirably alter the pumping forces exerted on the tubes.

A variety of approaches to pump design have been presented in an attempt to reduce tube migration. In one example, pumps have been developed in which each tube is located in a separate drive head. While this reduces the likelihood of tube migration, it is comparatively expensive, requiring redundant parts and additional assembly time.

In another approach, the tubes are stretched over respective rollers in such a way as to maintain the tubes under constant tension. This approach is usually used in conjunction with additional mechanisms to maintain precise parallelism between the rollers and the occlusion. Again, although this approach reduces the likelihood of tube migration, it is also comparatively expensive, often requiring additional parts, control systems, and assembly time.

It can be seen from the foregoing that the need exists for a simple, inexpensive, arrangement for securing tubes in peristaltic pumps.

SUMMARY OF THE INVENTION

The present invention is directed to a tube component of a pump having a rotary portion that compels the movement of a fluid by peristaltic compression of resilient tubing containing the fluid. The tube component has a plurality of adjacent resilient tubes, with a web interconnecting the adjacent resilient tubes. The web may be offset from the centerline of the tubes so as not to degrade the compressibility of the tubes.

DETAILED DESCRIPTION OF THE INVENTION

Figure 1:
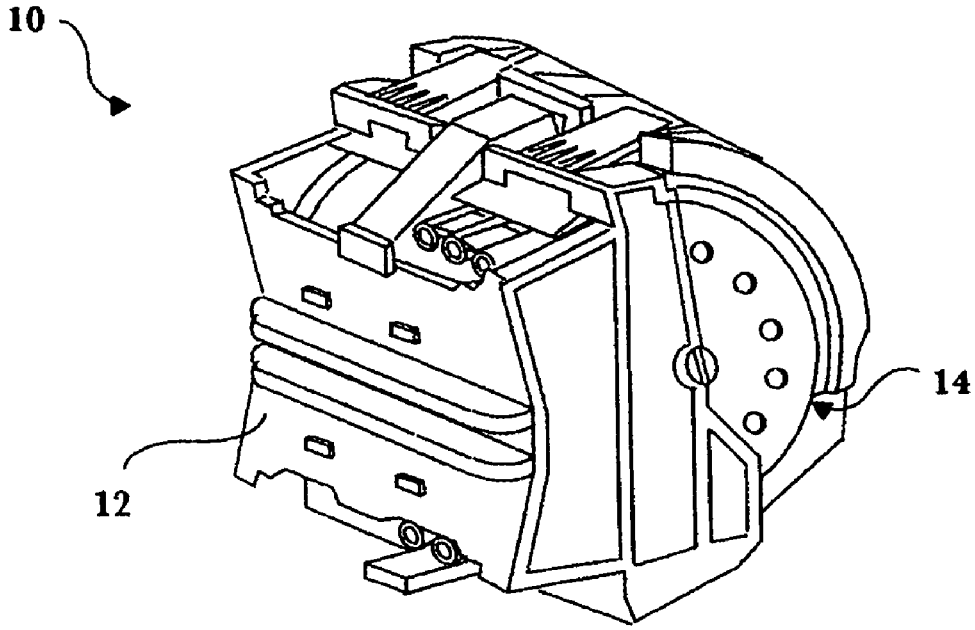
FIG. 1 is a schematic perspective view of an exemplary embodiment of a pump assembly in accordance with the principles of the present invention.

An embodiment of a peristaltic pump assembly 10 in accordance with the principles of the present invention is shown in FIG. 1. The pump assembly 10 is provided with an outer housing 12 enclosing a working portion 14. The housing 12 serves to protect the working portion 14 from its surroundings, and can also be configured to adapt the pump assembly 10 for fitting into the device in which it is installed. The pump assembly 10, as illustrated, is adapted and constructed to be employed in an imaging system, such as the ink supply system of an electronic printer. It is contemplated that the principles of the present invention are also applicable to any other system in which peristaltic pump having multiple flexible tubes is used.

Figure 2:
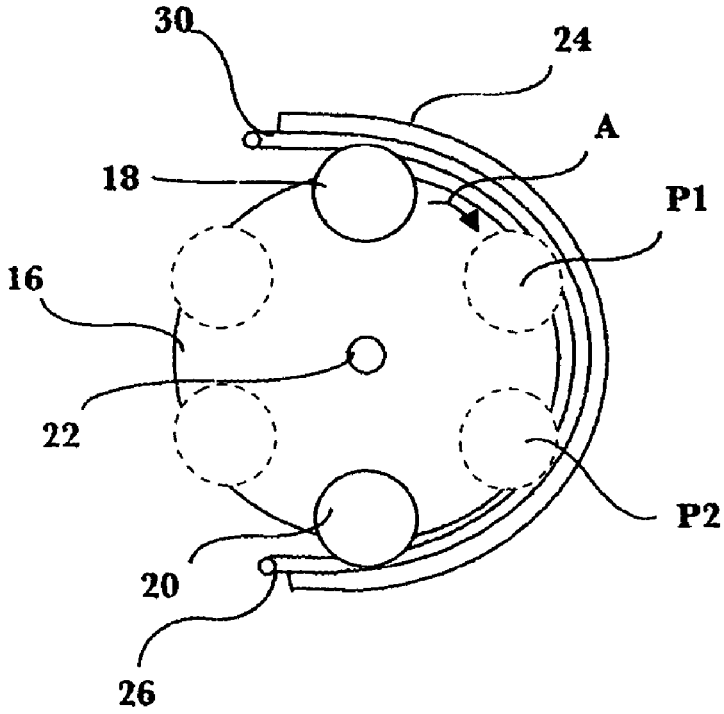
FIG. 2 is a schematic sectional view of the FIG. 1 embodiment.

As shown in FIG. 2, working portion 14 of the pump assembly 10 includes a rotor 16 having a plurality of rollers 18. The rollers 18 are mounted between a pair of opposed end plates 20. The rotor 16 is driven via a drive gear 22 for rotation about an axis 24.

A pump occlusion 26 partially surrounds the rotor 16. A tube component 28 is secured between the pump occlusion 26 and the rotor 16. The tube component 28 includes a plurality of flexible tubes 30, 32, 34 ganged together with a web 38. The pump occlusion 26 is radially spaced from the rollers 18, and provides a working surface such that rotation of the rotor 16 causes the rollers 18 to compress and collapse the tubes 30–34 against the occlusion 26 to impart motive force to fluid contained within the tubes 30–34 in a known manner. The web 38 prevents movement of the tubes 30–34 during operating of the pump assembly 10.

Figure 3:
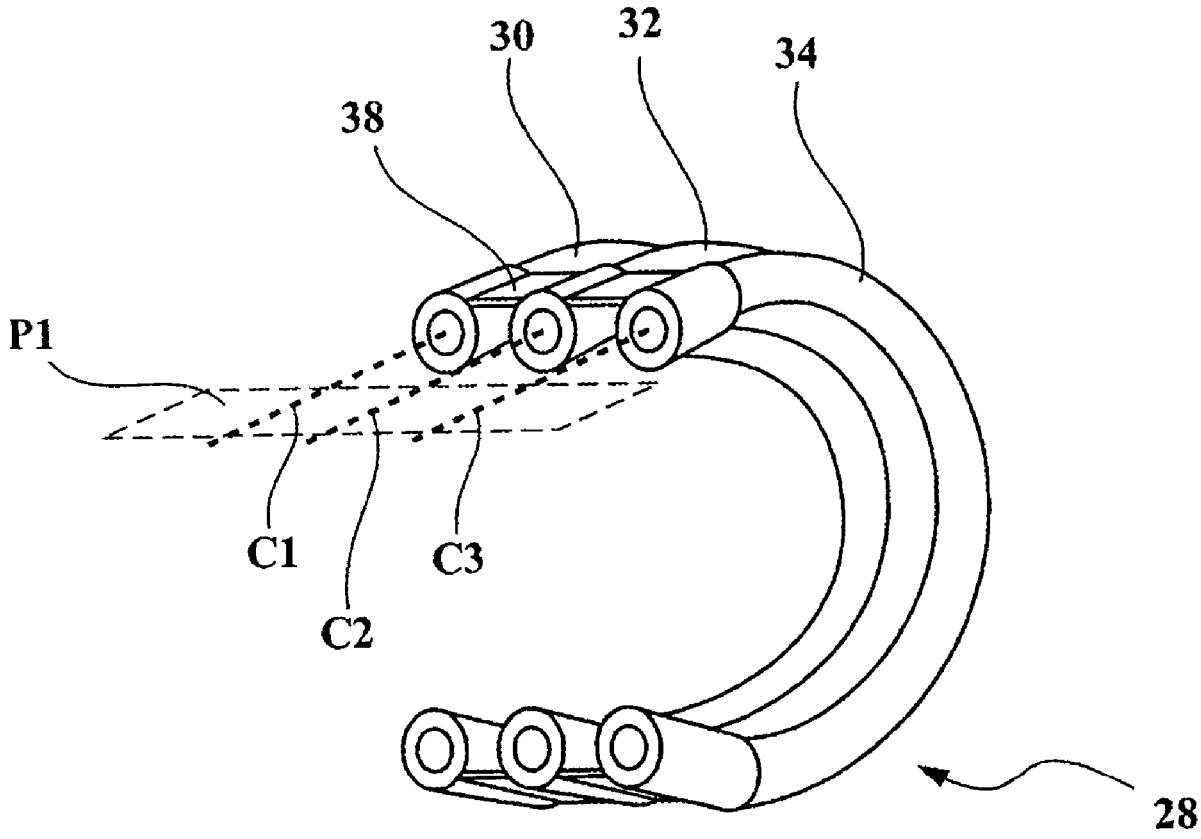
FIG. 3 is a schematic perspective view of an embodiment of a tube component in accordance with the principles of the present invention.

FIG. 3 illustrates the tube component 28 removed from the rest of the working portion 14 of the pump assembly 10. In the tube component 28, each of the resilient tubes 30–34 has a cross-sectional centerline C1, C2, C3 occurring in a common plane P1. The web 38 interconnects the resilient tubes 30–34 in an area outside of the common plane P1. This off-center placement of the web 38 provides several advantages. For example, in those instances in which the web 38 and tubes 30–34 are integrally formed, off-center placement of the web 38 facilitates fabrication of the tube component 28. Further, off-center placement reduces any effect that the web 38 may have on tube geometry during pump operation, in that the offset web does not interfere with the broadening of the tube as the tube is flattened.

It is also contemplated that advantages accrue from locating the web 38 outside of the rotary area of pump operation, i.e., outside of the area where the rotors 18 compress the tubes 30–34 against the occlusion 26.

The resilient tubes 30–34 can be formed from any suitable elastomeric material, such as a flexible plastic. The web 38 can be formed integrally with the tubes 30–34, or fabricated separately, then installed onto the tubes 30–34.

The web 38 permits the tubes 30–34 to function essentially as a unit, rather than as three independently variable tubes. Since the tube component 28 can be installed as a unit in the pump assembly 10, the time and complexity of assembling the pump is reduced.

Although the present invention has been described with reference to specific embodiments, those of skill in the art will recognize that changes may be made thereto without departing from the scope and spirit of the invention as defined by the appended claims.

What is claimed is:

1. In a pump having a rotary portion which compels the movement of a fluid by peristaltic compression of resilient tubing containing the fluid, a tube component comprising the following:

a plurality of adjacent resilient tubes; and an offset web interconnecting the adjacent resilient tubes, wherein the resilient tubes and the offset web are integrally formed, and each of the resilient tubes has a cross-sectional centerline occurring in a common plane and the offset web only interconnects the resilient tubes in an area outside of the common plane.

2. A tube component in accordance with claim 1, wherein the resilient tubes are fabricated from an elastomeric plastic material.

3. A tube component in accordance with claim 1, wherein the rotary portion of the pump includes a rotary area of pump operation, and the web is outside the rotary area of pump operation.

4. A method of assembling a pump having a rotary portion which compels the movement of a fluid by peristaltic compression of resilient tubing containing the fluid comprising the following:

providing a plurality of adjacent resilient tubes; and interconnecting the adjacent resilient tubes with an offset web, the resilient tubes and offset web being integrally formed, and wherein each of the resilient tubes has a cross-sectional centerline occurring in a common plane, the rotary portion of the pump includes a rotary area of pump operation, and the resilient tubes are only interconnected with the offset web in an area outside of the common plane and in an area outside the rotary area of pump operation.

5. A method in accordance with claim 4, wherein providing a plurality of adjacent resilient tubes comprises providing resilient tubes fabricated from an elastomeric plastic material.

* * * * *